US007780538B1

(12) United States Patent
Probst

(10) Patent No.: US 7,780,538 B1
(45) Date of Patent: Aug. 24, 2010

(54) COMPOSITELY STRUCTURED BILLIARD CUE TIP AND BILLIARD CUE UTILIZING SAME

(76) Inventor: Frederick E. Probst, 1218 Vitalia St., Santa Fe, NM (US) 87505

( * ) Notice: Subject to any disclaimer, the term of this patent is extended or adjusted under 35 U.S.C. 154(b) by 0 days.

(21) Appl. No.: 12/383,164

(22) Filed: Mar. 20, 2009

Related U.S. Application Data

(63) Continuation-in-part of application No. 11/906,685, filed on Oct. 3, 2007, now abandoned.

(51) Int. Cl.
*A63D 15/12* (2006.01)

(52) U.S. Cl. ..... 473/49; 473/51

(58) Field of Classification Search ..... 473/44–51
See application file for complete search history.

(56) References Cited

U.S. PATENT DOCUMENTS 1,230,122 A * 6/1917 Connell ..... 473/51
3,598,409 A * 8/1971 Nemecek ..... 473/49
4,688,796 A * 8/1987 Wright ..... 473/2
5,016,877 A * 5/1991 Lowery ..... 473/51
6,117,019 A * 9/2000 Taylor ..... 473/46
2007/0219009 A1* 9/2007 Sullivan ..... 473/49
2008/0139329 A1* 6/2008 Chang ..... 473/49

* cited by examiner

*Primary Examiner*—Mark S Graham
(74) *Attorney, Agent, or Firm*—Daniel Robbins

(57) ABSTRACT

A leather billiard cue tip has an insert embedded in the surface of the cue tip having a higher coefficient of friction relative to the cue ball than that of the leather tip itself. The insert has a mechanical compliance compatible with that of the leather tip, and is contoured to form a continuous smooth surface at the apex of the leather tip. The leather tip has a hardness that is not less than, i.e., that is equal to or greater than, the hardness of the insert. The composite of leather and insert provide a cue tip having enhanced friction when contacting the cue ball, diminishing sliding between the cue tip and cue ball during an off center billiard shot that significantly reduces the risk of miscuing while optimum hardness of the leather tip insures substantial maintenance of the structural geometry of the tip during and after a billiard shot.

13 Claims, 1 Drawing Sheet

COMPOSITELY STRUCTURED BILLIARD CUE TIP AND BILLIARD CUE UTILIZING SAME

This is a continuation-in-part of application Ser. No. 11/906,685, filed Oct. 3, 2007, now abandoned.

BACKGROUND OF THE INVENTION

1. Field of the Invention

This invention relates to accessories for the game of billiards, and in particular to a billiard cue tip and to a billiard cue.

2. Description Relative to the Prior Art

Interest and participation in the game of billiards has grown rapidly in the U.S. over the past decades. It is estimated that there are more than 36 million participants in the game at present, and they range across the spectrum of home and local billiard parlor amateur players to professional championship contestants. Along with this growth in participation and improvement in skills, there has been an increased demand for improved billiard accessories by both amateur and professional players.

An area of perennial interest has been the improvement of cue tips and cues for executing off center billiard shots, such as right and left English, draw and follow shots. Having the ability to skillfully execute these shots when challenged by the infinite number of ball positions possible on the table during a game is the mark of the proficient player. Such shots, where the direction of the force applied to the ball by the stroke of the cue does not go through the center of the cue ball so that spin is imparted to the cue ball, is described and fully analyzed in U.S. Pat. No. 5,725,437.

A successful off center shot requires non-sliding contact between the cue tip and the cue ball during impact. That is, during tip/cue ball engagement high friction is required, and this necessitates a large coefficient of static friction between the tip and the ball. A successful stroke imparts both controlled spin and forward motion to the cue ball. Over a long period of time and much experimentation, the overwhelming material of choice for the cue tip, by players of all calibers, has been leather. A wide variety of leathers have been utilized in tip fabrication, including pig skin, cowhide, elk, buffalo and boar hides, as well as the hides of more exotic animals, and the reason for the choice of leather has been, an acceptable but not necessarily optimum, coefficient of static friction between the tip and cue ball. During play, rubbing fine chalk particles from a chalk block onto the cue tip further enhances the friction.

Another important parameter affecting control of off-center billiard shots is the hardness of the leather cue tip. Cue tip hardness, or density, is measured by means of a durometer, and tip hardness ranges from a value of 60 for a soft tip to above 80 for a hard tip. Cue tips in the hardness range of 76-80, are characterized as medium hard tips, and are generally regarded as an optimum choice for typical play. Tip hardness selection is a matter of personal preference of the billiard player, and consideration of opposing parameters is of primary importance in tip selection. A soft tip gives more flexibility in an off center shot, while preservation of contour is better effected by a harder tip.

Despite the ongoing popularity of the leather tip, there have been continuing disclosures in the prior art exploring non-leather tips that claim superior friction characteristics. As far back as 1867, U.S. Pat. No. 71,925 disclosed a composition comprising a mixture of rubber, ground leather, chalk, emery and crocus from which a high friction cue tip is fabricated.

U.S. Pat. No. 3,381,960 discloses a tip of a mixture of polyurethane elastomer and leather flour, while U.S. Pat. No. 3,695,611 discloses one comprising neoprene and filler.

Unlike the above proposed non leather cue tips, the cue tip of the present invention substantially increases the friction between the cue tip and cue ball without surrendering the use of the currently popular leather cue tip.

SUMMARY OF THE INVENTION

A leather billiard cue tip has an insert embedded in the surface of the cue tip having a higher coefficient of friction relative to the cue ball than that of the leather tip itself. The insert is contoured to form a continuous smooth surface at the apex of the leather tip. The leather tip has a hardness not less than, i.e., is equal to or greater than, the hardness of the insert. The composite of leather and insert provide a cue tip having enhanced friction when contacting the cue ball, diminishing sliding between the cue tip and cue ball during an off center billiard shot that significantly reduces the risk of miscuing, while optimum hardness of the leather tip insures substantial maintenance of the structural geometry of the tip during and after a billiard shot.

BRIEF DESCRIPTION OF THE DRAWINGS

The invention will be described with respect to the figures of which.

DESCRIPTION OF THE PREFERRED EMBODIMENTS

Figure 1:
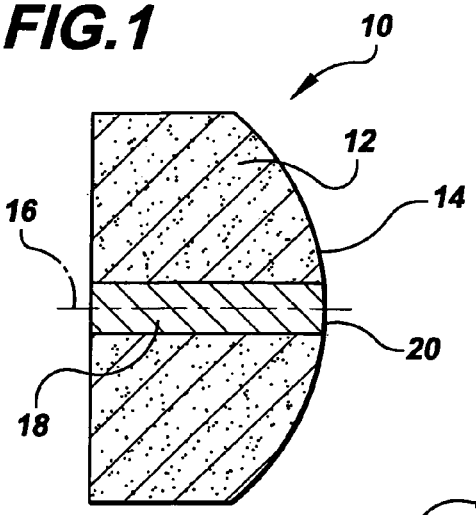
FIG. 1 is a drawing of the cross section of a cue tip of the invention.

Referring to FIG. 1, leather cue tip 10 has a leather body, 12, whose front face is contoured as an arcuate surface, 14. The radius, of the arcuate surface, 14, is a matter of design choice, and may even have an infinite value, i.e. the surface, 14, can be planar. The cue tip, 10, has a polar axis, 16, and a core, 18, is inserted into, and embedded in a cavity bored in the cue tip, 10, along its polar axis, 16, to provide enhanced friction at the cue tip, 10, during a billiard stroke. The core, 18, is an elastic element selected to have a hardness less than or equal to the hardness of the leather cue tip's body, 12, and to have a coefficient of friction relative to a cue ball greater than that of the leather cue tip, 10, alone. Suitable elements for the core, 18, are elastomers that include natural rubber, neoprene, and other synthetic rubbers, as well as thermoplastic elastomers. The front face, 20, of the core, 18, is contoured to provide a smooth transition to the arcuate surface, 14.

EXAMPLE

A cue tip in accordance with the invention was fabricated as follows. A leather tip, 10, of French style named Le Professionel, manufactured by Tweeten Fibre Co., Chicago, Ill., was modified by drilling a bore through the tip, 10, along its polar axis, 16. The leather tip, 10, was of medium hardness having a durometer value of 72.6. A 0.125" nominal diameter cylindrical rubber core, 18, was inserted and glued into the cue tip bore, and its front end contoured to provide a smooth transition with the arcuate surface, 14, of the tip, 10. The core,

18, was a rubber cylinder O-ring core of Shore A Durometer 70, available from McMaster-Carr Supply Co.

Figure 2:
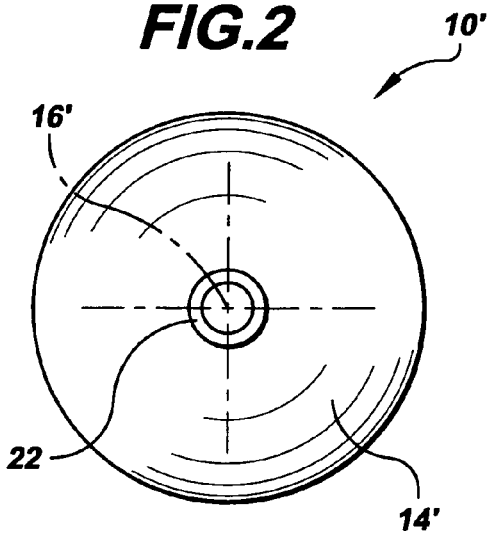
FIG. 2 is a drawing of a second embodiment of the invention.

Referring to FIG. 2, in a second embodiment, a small elastomer O-ring, 22, is inserted and glued into a circular groove cut into the arcuate surface, 14', of a leather cue tip, 10'. (In the drawings, different but related elements are identified with the same reference character, albeit that the different elements are distinguished by primes.) The O-ring, 22, is then contoured for a smooth transition with the arcuate surface, 14'. Considering the end of the polar axis, 16,' as the pole of cue tip, 10', the O-ring, 22, is positioned symmetrically as a circle of latitude with respect to the polar axis, 16', of cue tip 10'. The diameter and hardness of the O-ring, 22, is determined by the skill and preferences of the billiard player using the cue tip, 10'.

Figure 3:
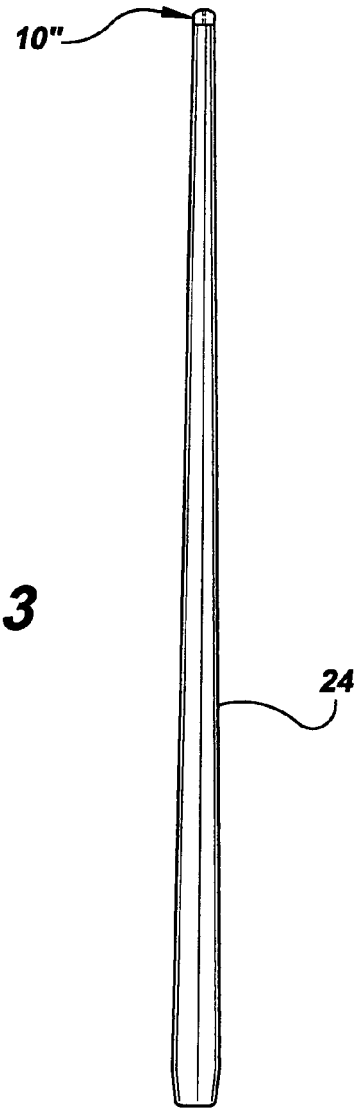
FIG. 3 is a drawing of a cue stick incorporating the cue tip of the invention.

In FIG. 3, a cue tip, 10", is attached for use with a cue stick, 24. A standard method of attaching the cue tip, 10", to the cue stick, 24, generally utilizing a ferrule, is well known in the art.

It will be noted that this specification has described the invention in terms of billiards, but it will be appreciated that the teachings of the invention apply not only to billiards, but also to pool, snooker, and equivalent cue stick/cue ball games. Additionally, the invention has been described with reference to specific illustrations and examples, but it will be understood that various modifications can be made without departing from the spirit of the principles and teachings of the invention. Accordingly, the invention is limited only by the following claims.

What is claimed is:

1. A cue tip for engaging a cue ball, said cue tip comprising:

a) a leather body, said leather body having an arcuately symmetrically shaped leather surface of a first coefficient of friction relative to said cue ball, b) a bore through said cue tip, said bore extending through said leather body and said leather surface, c) an elastomer shaped to conform to said bore, said elastomer secured into said bore wherein an end of said elastomer extends through said leather surface, and said end is configured to conform to said leather surface, d) said elastomer further having a coefficient of friction greater than said first coefficient of friction relative to said cue ball, and e) said leather body having a hardness greater than the hardness of said elastomer.

2. The cue tip of claim 1 wherein said bore and said elastomer have cylindrical congruent shapes.

3. The cue tip of claim 1 wherein said elastomer is natural rubber.

4. The cue tip of claim 1 wherein said elastomer is a synthetic rubber.

5. The cue tip of claim 1 wherein said elastomer is a thermoplastic.

6. A cue stick comprising:

a) a stick adapted for striking a cue ball, said cue stick further comprising, b) a cue tip comprising an arcuately shaped leather body having a leather surface of a first coefficient of friction relative to said cue ball, c) an elastomer having a second coefficient of friction relative to said cue ball, said elastomer symmetrically embedded in said leather surface wherein a section of said elastomer is configured to conform to the shape of said leather surface, and further wherein said second coefficient of friction is greater than said first coefficient of friction, and e) said leather body has a hardness greater than the hardness of said elastomer.

7. The cue tip of claim 6 wherein said elastomer is natural rubber.

8. The cue tip of claim 6 wherein said elastomer is a synthetic rubber.

9. The cue tip of claim 6 wherein said elastomer is a thermoplastic.

10. A cue tip for engaging a cue ball, said cue tip comprising:

a) an arcuately shaped leather body having a leather surface having a first coefficient of friction relative to said cue ball, b) an elastomer in the form of an "O" ring, said "O" ring having a second coefficient of friction relative to said cue ball, said second coefficient of friction being greater than said first coefficient of friction, c) said "O" ring being symmetrically embedded in said leather body wherein the portion of said "O" ring coincident with said leather surface is configured to conform to the shape of said leather surface, and d) said "O" ring further having a compressibility compatible with said leather surface.

11. The cue tip of claim 10 wherein said elastomer is natural rubber.

12. The cue tip of claim 10 wherein said elastomer is a synthetic rubber.

13. The cue tip of claim 10 wherein said elastomer is a thermoplastic.

* * * * *